US006545428B2

(12) United States Patent
Davenport et al.

(10) Patent No.: US 6,545,428 B2
(45) Date of Patent: Apr. 8, 2003

(54) LIGHT FIXTURE WITH SUBMERSIBLE ENCLOSURE FOR AN ELECTRIC LAMP

(75) Inventors: John M. Davenport, Lyndhurst, OH (US); Roger F. Buelow, II, Cleveland Heights, OH (US); David Y. Lin, Castro Valley, CA (US); Ray A. Buchina, Mentor, OH (US); Gregory P. Frankiewicz, LaGrange, IL (US)

(73) Assignee: Fiberstars Incorporated, Solon, OH (US)

( * ) Notice: Subject to any disclaimer, the term of this patent is extended or adjusted under 35 U.S.C. 154(b) by 53 days.

(21) Appl. No.: 09/919,542

(22) Filed: Jul. 31, 2001

(65) Prior Publication Data

US 2003/0026097 A1 Feb. 6, 2003

(51) Int. Cl.[7] ..... H05B 41/24; F21V 29/00

(52) U.S. Cl. ..... 315/276; 315/283; 315/289; 362/267; 361/833

(58) Field of Search ..... 315/57, 70, 276, 315/289, 283, DIG. 2, DIG. 5; 362/267, 276, 310, 802; 361/833, 834; 340/693.1, 693.3, 693.5, 852

(56) References Cited

U.S. PATENT DOCUMENTS

| | | | | |
|---|---|---|---|---|
| 4,216,411 A | | 8/1980 | Ehret et al. | 315/118 |
| 4,246,575 A | | 1/1981 | Purtell et al. | 340/605 |
| 4,752,401 A | * | 6/1988 | Bodenstein | 210/746 |
| 4,888,455 A | | 12/1989 | Hanson | 340/602 |
| 5,539,383 A | | 7/1996 | Chin | 340/604 |
| 5,602,446 A | * | 2/1997 | Kolber et al. | 315/241 P |
| 6,021,033 A | | 2/2000 | Benham et al. | 361/42 |

OTHER PUBLICATIONS

Definition of "capacitor" from http://aj. encyclopedia.com/articles/02263.html (Jul. 5, 2001), one page.

Hydrel Standard Data Sheets—4428–LWC Rev. 3(Apr. 2000), 4 pages.

* cited by examiner

*Primary Examiner*—Don Wong
*Assistant Examiner*—Thuy Vinh Tran
(74) *Attorney, Agent, or Firm*—Charles E. Bruzga

(57) ABSTRACT

A light fixture with a submersible enclosure for an electric lamp (e.g, HID lamp) is disclosed. The fixture includes a ballast for supplying power to a high intensity discharge lamp. A submersible enclosure seals the lamp from water in normal operation. The fixture includes a water-sensitive circuit having a conductance that increases in response to water that leaks into the enclosure for conducting current from the ballast and limiting the ballast voltage. Alternatively, the submersible enclosure may contain a power lead for supplying power to an electrical load such as a lamp ballast, a non-ballasted lamp, or a color wheel. The power lead includes a fuse region that corrosively reacts in the presence of leaked water in the container, so as to sufficiently wither away the fuse region and terminate power to the load. The foregoing alternative versions may advantageously be combined.

44 Claims, 9 Drawing Sheets

LIGHT FIXTURE WITH SUBMERSIBLE ENCLOSURE FOR AN ELECTRIC LAMP

FIELD OF THE INVENTION

The present invention relates to a light fixture with a submersible enclosure for an electric lamp, especially for a High Intensity Discharge (HID) lamp, and, more particularly, to a light fixture that prevents undesirably high voltages from developing.

BACKGROUND OF THE INVENTION

The use of HID lamps for lighting swimming pools has proven to be an attractive, efficient and long-lived alternative to the use of incandescent and halogen lamps. However, due to the relatively high voltages that are either momentarily required for starting HID lamps or that may be present continuously in the event of a lamp failure, the application of HID lamps to pool lighting has been limited to fiberoptics, such as Fiberstars FS6000 and Fibersrtars Underground™ fiberoptic systems sold by Fiberstars Incorporated of Fremont, Calif.

Fiberoptic lighting systems avoid the problem of high voltage by locating the light source at a location remote from the pool. Additionally, these HID fiberoptic illumination systems may be configured to chance color in a pleasing, continuous manner by simply including a color wheel. The latest HID systems are also extremely energy efficient, often providing the illumination of a 500-watt pool light but using only 75 watts of electrical power. Moreover, HID lights are often advertised as "life of the pool" illumination, typically lasting several times the life of a halogen or incandescent pool lamp. Unfortunately, because HID fiberoptic lighting systems require trenches to accommodate fiber (and in some cases to bury the illuminator) these HID fiberoptic systems are only practical for new construction pools where the installation is economically viable.

Unfortunately, the majority of existing illuminated pools use incandescent or halogen lights mounted in a "niche" in the pool wall, below the water line. If HID lamps could be made to operate in this underwater environment, then the considerable benefits of HID lighting systems could be made available to all pools where lighting is desired, and would not require not fiberoptics.

It would additionally be desirable, for both ballasted and non-ballasted electrical lamps or other devices contained in an enclosure submersed in water, to prevent undesirably high voltages while keeping manufacturing costs low.

SUMMARY OF THE INVENTION

An exemplary embodiment of the invention provides a light fixture with a submersible enclosure for a gas discharge lamp such as an HID lamp. The fixture includes a ballast for supplying power to the lamp. A submersible enclosure seals the lamp from water in normal operation. In a first embodiment, the fixture includes a water-sensitive circuit having a conductance that increases in response to water that leaks into the enclosure for conducting current from the ballast and limiting the ballast voltage. In a second embodiment, the submersible enclosure contains a hot or common power lead for supplying power to an electrical load such as a lamp ballast, a non-ballasted lamp or a color wheel. The power lead includes a fuse region that corrosively reacts in the presence of leaked water in the container, so as to sufficiently wither away the fuse region and terminate power to the load. The first and second embodiments may be advantageously combined.

The foregoing light fixtures can beneficially avoid undesirably high voltages for a lamp ballast, a non-ballasted lamp or other electrical load. For an HID lamp in particular, a light fixture can be long-lived and economical.

DESCRIPTION OF THE DRAWINGS

In the following drawings, like reference numerals refer to like parts.

DETAILED DESCRIPTION OF THE INVENTION

The present description first describes a water-sensitive circuit and then a fuse region that may be used independently or together.

Water-Sensitive Circuit

Figure 1:
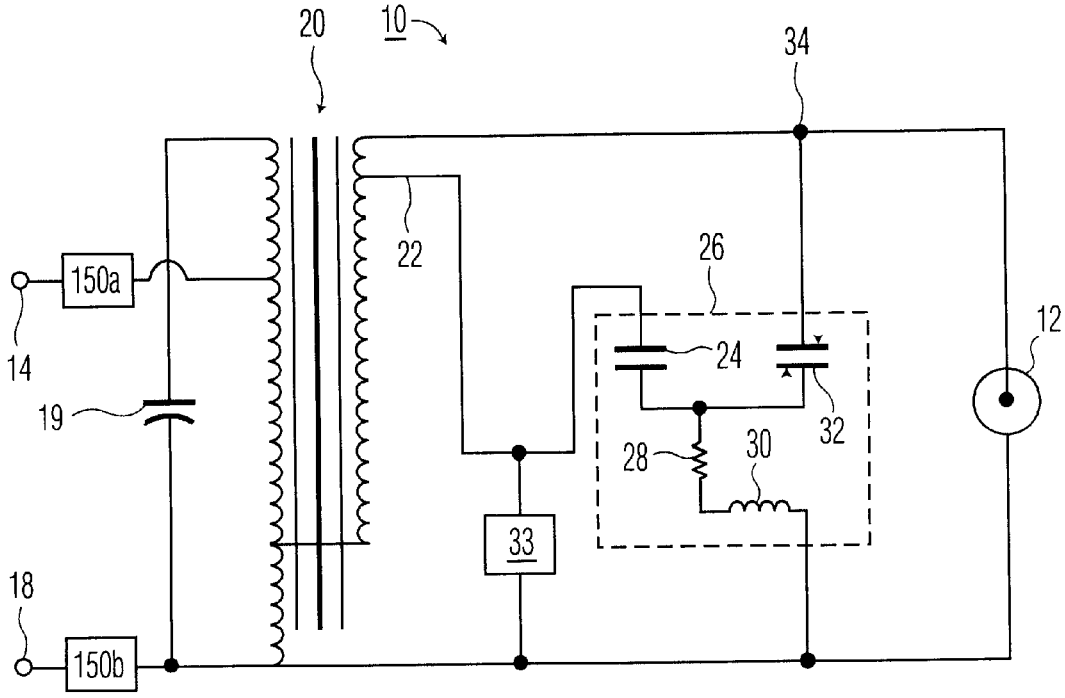
FIG. 1 is a schematic diagram, partly in block, of a ballast circuit for a gas discharge lamp in accordance with one embodiment of the invention.

FIG. 1 shows a ballast circuit 10 for powering a gas discharge lamp 12, such as a metal halide high intensity discharge (HID) lamp. Supply mains (not shown) provide voltage between a so-called "hot" node 14 and a common node 18. Although not shown, common node 18 is customarily connected to an earth ground near a circuit-breaker panel remote from lamp 12. As used herein, a "node" refers to all parts of a circuit interconnected by a conductor or conductors, with insubstantial resistance between such parts during normal device operation. An optional capacitor 19 connected across the input side of a magnetic ballast 20 may be used for power factor correction. Boxes 150*a* and 150*b* represent optional fuse regions of lead portions of nodes 14 and 18, described below.

Ballast 20, which may be a Venture 50-watt model V90J531C autotransformer lag ballast, supplies a voltage between a node 22 at a tap of its secondary winding and node 18 for charging a capacitor 24 of an igniter 26, such as a Venture model BVS-032 igniter. The Venture products mentioned in this specification are available from Venture Lighting International of Solon, Ohio, USA. Ultimately, igniter 26 creates high voltage spikes, typically reaching 3,500 volts, when the voltage on node 22 reaches a threshold level, such as 250 volts. The high voltage spikes are impressed across lamp 12 for starting the lamp.

When capacitor 24 reaches a threshold level, SIDAC 32 switches into conduction and causes a brief period of high current in the output winding of ballast 20 via the capacitor in well-known manner. This, in turn, induces a high voltage spike across the lamp for each current pulse. A high frequency choke 30 prevents the spikes from conducting through the igniter.

A water-sensitive circuit 33 is connected between nodes 18 and 22 so as to be serially connected to ballast 20. As will be obvious to those of ordinary skill in the art, a resistor or other device or devices (not shown) can be included between node 22 and circuit 33, for instance, while still maintaining the serial connection of circuit 33 to the ballast. Circuit 33 normally has a low conductance, for instance, conducting less than 50 percent of normal lamp current, and preferably a negligible conductance, for instance, conducting less than 1 percent of normal lamp current. Its function of increasing in conductance in the presence of leaking water will be described below.

Figure 2:
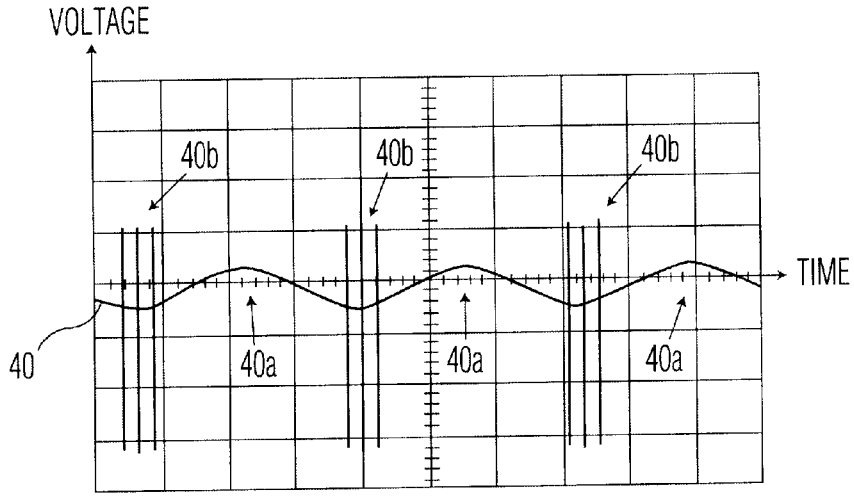
FIG. 2 is a waveform of lamp voltages in the absence of leaking water.

Ballast 20 also provides the operating voltage for the lamp, between its output node 34 and node 18. Typically, that operating voltage may be from about 85 to about 100 volts in amplitude, and is bidirectional. FIG. 2 shows a typical voltage waveform 40 provided by ballast 20 to start the lamp. Waveform 40 includes portions 40*a* that are periodic, and portions 40*b* that include high voltage starting spikes from the igniter.

When the lamp is placed in an enclosure, as will be shown below, and the enclosure is then submerged underwater and, through a breach, takes in water, any or all of three objects are desired: First, it is desired to prevent the igniter from creating high voltage (starting) spikes 40*b* (FIG. 2). Second, it is desired to make the voltage waveform provided by the ballast similar to the waveform supplied by the power mains (e.g., generally sinusoidal), so that electrical certification authorities (e.g., Underwriters Laboratory) can readily certify the light fixture. Third, it is desired to limit the amplitude of the voltage provided by the ballast so that electrical certification authorities can readily certify the light fixture. It is preferred, but not critical, to limit the amplitude to the voltage supplied by the power mains (not shown), for instance, about 170 volts. The first and third factors may be summarized as preventing undesirably high voltages.

Water-sensitive circuit 33 can fulfill any or all the foregoing objectives. In the presence of water leaking into a submersed enclosure (shown below), its conductance increases. Preferably, the increase is sufficient to accomplish all three objectives.

Figure 3:
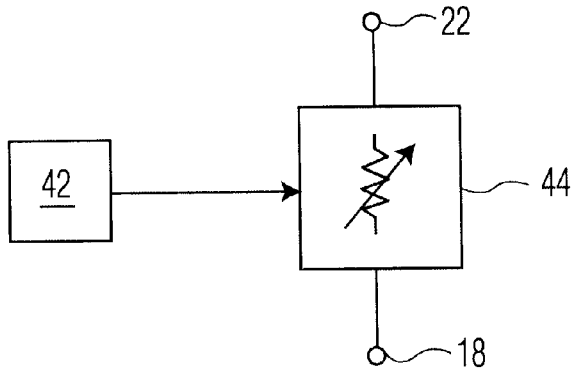
FIG. 3 is a schematic diagram in block form of a typical water-sensitive circuit used in a ballast circuit such as that of FIG. 1.

FIG. 3 shows a schematic construction of a typical water-sensitive circuit 33. In that figure, block 42 represents a water sensor connected between nodes 18 and 22 so as to be serially connected to ballast 20 (FIG. 1). It cooperates with a variable-conductance device 44 to substantially increase the conductance of device 44 in the presence of leaking water. Water sensor 42 could be an electronic circuit (not shown) for sensing water or humidity. Variable-conductance device 44 could be a soft switch, i.e., a switch that does not necessarily turn fully off or fully on, such as a resistive or inductive switch, or it could be a hard switch.

By way of example, water-sensitive circuit 33 (FIG. 1) may comprise a compressed, dehydrated cellulose sponge with conductive plates attached to opposing faces as disclosed in U.S. Pat. No. 4,246,575, issued Jan. 20, 1981; a water-activated dielectric capacitor as disclosed in U.S. Pat. No. 5,539,383 issued Jul. 1, 1993; a pair of contacts spaced apart by material that becomes frangible when moistened as disclosed in U.S. Pat. No. 4,888,455 issued Dec. 19, 1989; or any of the many combinations of water-sensitive circuit devices and hard or soft switches that will be obvious to those of ordinary skill in the art.

Figure 4:
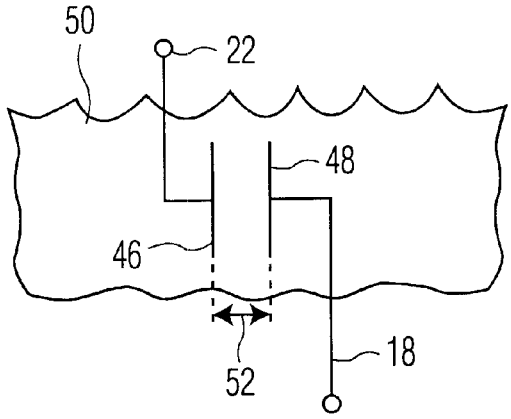
FIG. 4 is a simplified schematic of a water-sensitive circuit in accordance with the invention.

FIG. 4 shows a preferred form of water-sensitive circuit 33 (FIG. 1) comprising first and second electrodes 46 and 48, respectively. Each electrode has the shape of a leaf, and each is preferably parallel to the other. Water 50 that has leaked into the enclosure (not shown) containing lamp 12 (FIG. 1) partially or completely fills the volume between the electrodes so as to increase the conductance between electrodes 22 and 18. To facilitate this, the electrodes may be oriented generally vertically. The minimum spacing between the electrodes is chosen to withstand the voltage generated between nodes 18 and 22 when igniter 26 (FIG. 1) creates high voltage spikes (e.g., 40*a* in FIG. 2). As will become clear from the following description, in other embodiments, the minimum spacing is chosen with different considerations.

The conductance between nodes 18 and 22 is determined by three factors: (1) the spacing 52 between electrodes 46 and 48, which are assumed parallel to each other, (2) the coextensive areas of the electrode that are orthogonal to each other, and (3) the conductivity of water 50.

For typical swimming pool or spa water that contains chlorine or other chemicals or contaminants, the lowest practical conductivity of water is typically $1/30{,}000$ mho-cm. In order to prevent undesirably high voltages, as defined above, the conductance of the water-sensitive circuit preferably exceeds $1/200$ mhos for a typical 50-watt magnetic ballast. The selection of a suitable conductance value for any given circuit will be obvious to persons of ordinary skill in the art based on the present disclosure.

Beneficially, the water-sensitive circuit of FIG. 4 typically acts instantly to limit ballast voltage and is simple in construction.

Figure 5:
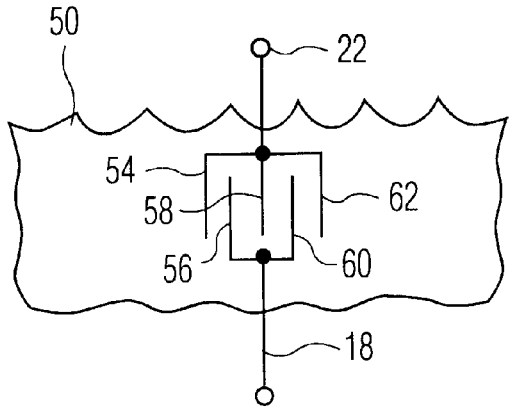
FIG. 5 is a simplified schematic of another water-sensitive circuit according to the invention.

FIG. 5 shows a preferred variation of the circuit of FIG. 4, in which a first electrode 54 is connected to node 22, a second electrode 56 is connected to node 18, a third electrode 58 is connected to node 22, a fourth electrode 60 is connected to node 18, and a fifth electrode 62 is connected to node 22. This arrangement of electrodes, which are preferably in leaf form, provides a compact water-sensitive circuit. This is because the water 50 in each of the volumes between pairs of confronting electrodes, 54–56, 56–58, 58–60, and 60–62, is open to receive leaking water and thereby contribute to the overall conductance of the water-sensitive circuit.

Figure 6:
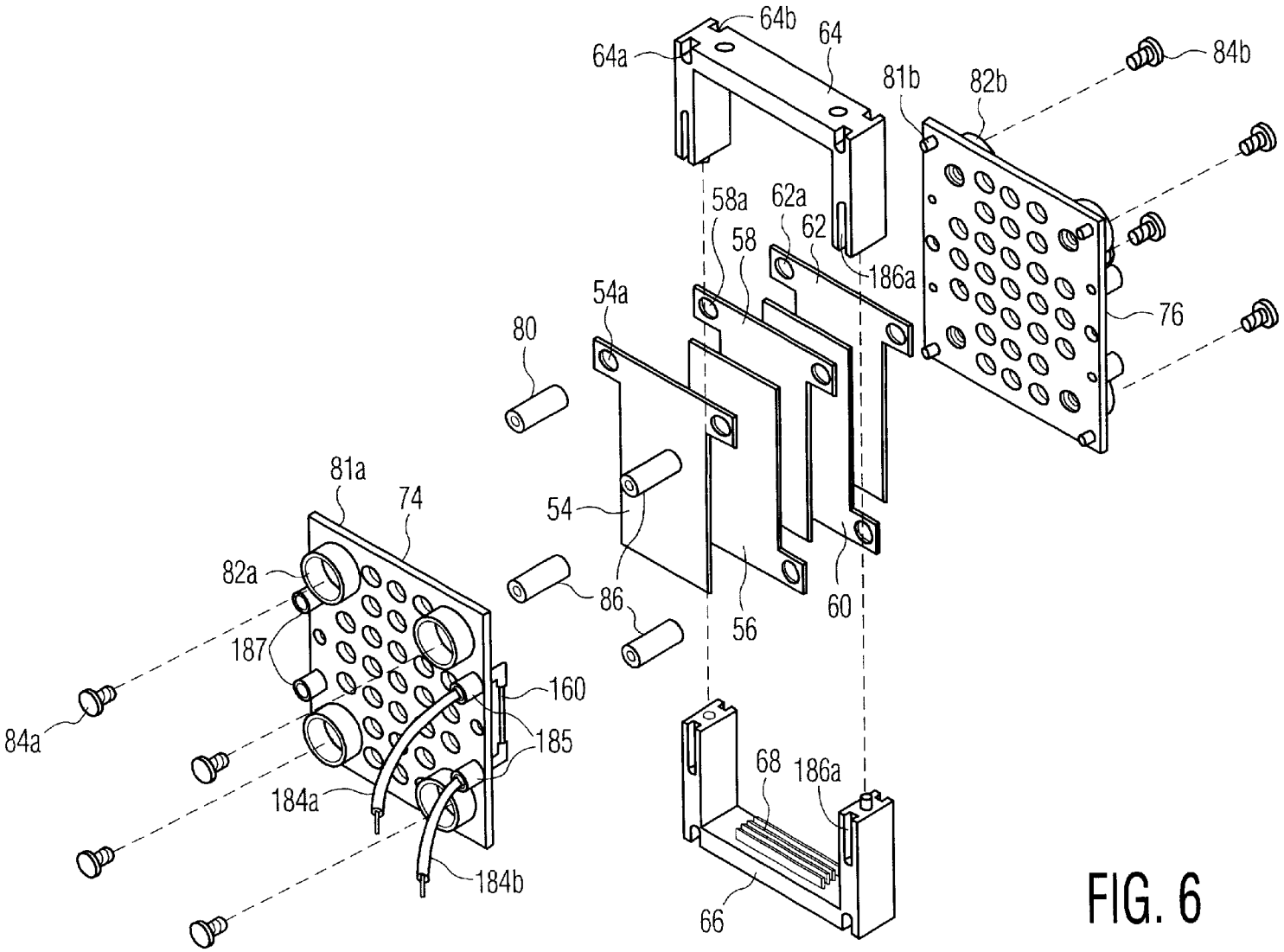
FIG. 6 is a perspective view in exploded form of a water-sensitive circuit using the arrangement of electrodes as shown in FIG. 5.

FIG. 6 shows a preferred construction of a water-sensitive circuit using the electrode arrangement 54–62 of FIG. 5. Top- and bottom-shown electrically insulating frame members 64 and 66 together enclose and support electrodes 54–62. To maintain the inter-electrode spacing, slots 68 in member 66 and corresponding slots (not shown) in member 64 receive the outer edges of the electrodes. Left- and right-shown electrically insulating frame members 74 and 76, each with unnumbered openings (e.g., circular holes as shown or slots) for water, respectively cover the outer electrodes 54 and 62. For securing the various frame members and electrodes, corner post 80 passes through holes 54*a*, 58*a* and 62*a* in electrodes 54, 58 and 62, respectively. The exterior of corner post 80 is electrically non-conductive to avoid shorting together the foregoing electrodes. Respective alignment posts 81*a* and 81*b* extend inwardly from frame members 74 and 76 and are received within respective alignment slots 64*a* and 64*b* of frame member 64. Respective standoffs 82*a* and 82*b* extend outwardly from frame members 74 and 76. Screws 84*a* and 84*b* pass through standoffs 82*a* and 82*b*, respectively, and are secured into opposite ends of corner post 80. Other corner posts 86 and associated parts are like just-described post 80 and its associated parts. The foregoing electrically insulating frame members 64, 68, 74 and 76 may be formed of a suitable plastic or ceramic, for instance, as will be apparent to those or ordinary skill in the art.

Figure 7:
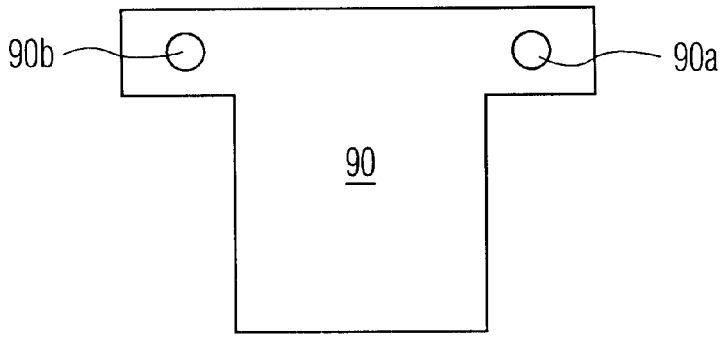
FIG. 7 is a plan view of an electrode used in the water-sensitive circuit of FIG. 6.

Each of electrodes 54–62 may have the shape of electrode 90 shown in FIG. 7, with a pair of holes 90*a* and 90*b*. Accordingly, the posts 80 and 86 will collectively pass through two holes in each electrode.

Figure 8:
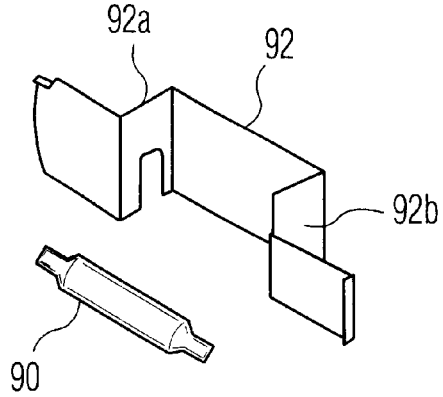
FIG. 8 shows a gas discharge lamp and reflector that may be used in the present invention.

FIG. 8 shows a double-ended gas discharge lamp 90 and reflector 92 that may be used in the present invention. The ends of lamp 90 normally protrude through slots 92*a* and 92*b* of the reflector.

Figure 9:
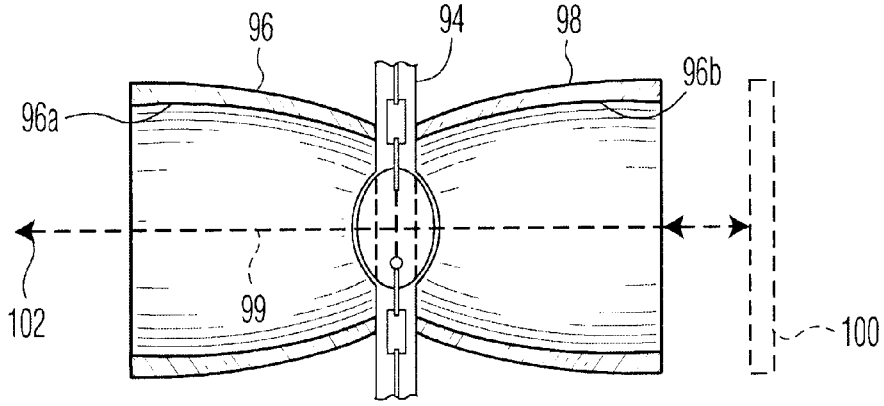
FIG. 9 is a side plan view of a preferred lamp and optical coupling devices.

FIG. 9 shows a lamp 94 comprising a double-ended, high intensity discharge (HID) metal halide lamp and preferred light coupling devices 96 and 98. Devices 96 and 98 couple light from the lamp to an output destination through a concentrated light beam (not shown). Beneficially, a small color wheel (not shown) can be used, which reduces the size requirement for the light fixture. The devices may be symmetrical to each other, so the following description of device 96 applies to the like-numbered parts of device 98.

Device 96 is generally tubular and has a respective, interior light-reflecting surface 96*a* for receiving light at an inlet end, nearest the lamp, and for transmitting it to an outlet end shown at the right. Typically, most of the inlet end of the coupling device preferably extends half-way across the lamp, preferably with recesses (unnumbered) for receiving the top and bottom arms of the lamp. The coupling device preferably increases in cross-sectional area from inlet to outlet in such manner as to reduce the angle of light reflected from its interior surface as it passes through the device, while transmitting it as a generally diverging light beam through the outlet. By "generally diverging" is meant that a substantial number of light rays diverge from a main axis 99 of light propagation, although some rays may be parallel to the axis. Preferably, substantially all cross-sectional segments of surface 96*a* orthogonal to main axis 99 substantially conform to a compound parabolic collector (CPC) shape. A CPC is a specific form of an angle-to-area converter, as described in detail in, for instance, W. T. Welford and R. Winston, High Collection Nonimaging Optics, New York: Academic Press, Inc. (1989), chapter 4 (pp. 53–76).

An optional mirror 100 reflects light from lamp 94 back through lamp 94 and to the left through device 96, in the direction of an arrow 102. As an alternative to mirror 100, a mirror or prism (not shown) at the outlet of device 98, along axis 99, could redirect light generally orthogonally to the axis, and another mirror or prism (not shown) at the outlet of device 96 could redirect light generally orthogonally to the axis.

As an alternative to the FIG. 9 arrangement, a single device such as device 96 could be used. To capture and redirect light to the left that would otherwise exit lamp 94 to the right from the perspective of FIG. 9, either the right-hand shown side of the lamp could be coated with an interiorly reflecting coating (not shown), or the lamp could be located at the focus of a spherical half mirror (not shown) placed to its right. Or, the light directed to the right could be ignored (and unused).

Figure 10:
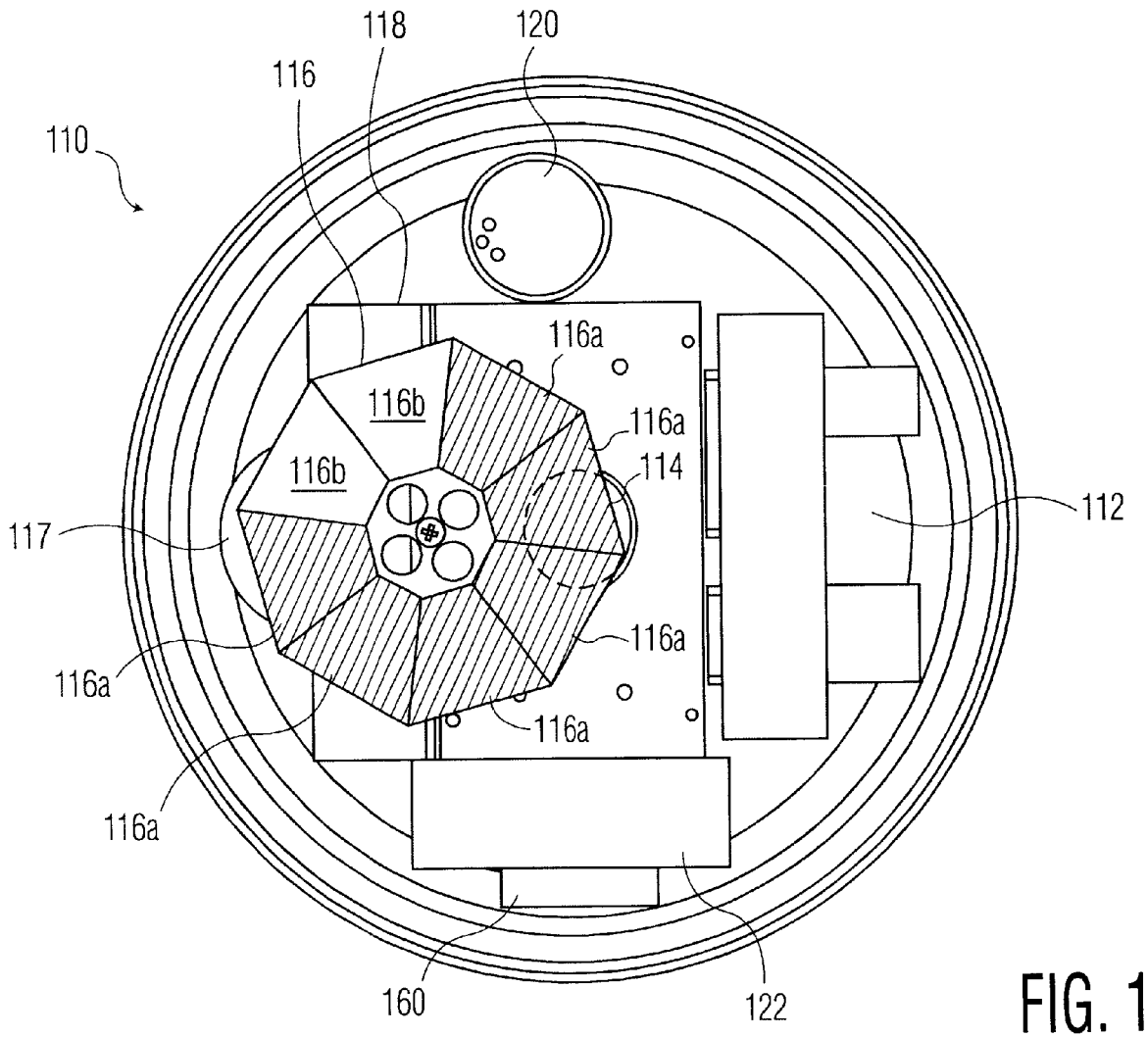
FIG. 10 shows a typical arrangement of parts in a light fixture incorporating the present invention.

FIG. 10 shows a typical arrangement of parts in a light fixture 110 incorporating the present invention. Fixture 110 may be of standard size so as to fit within a typical mounting niche in a pool. Magnetic windings 112 of ballast 20 (FIG. 1) are horizontally adjacent a partially visible lamp 114. A color wheel 116 and its turning motor 117 are mounted on frame 118, and may include colored segments 116*a* and transparent segments 116*b*. An igniter 120 (e.g., 26 in FIG. 1) is placed at the top of the fixture. Water-sensitive circuit 122 (e.g., 33 in FIG. 1) is beneficially placed at the bottom of the fixture, beneath the igniter, so as to receive the first water to leak into the enclosure.

Advantageously, the lamp arrangement of FIG. 9, described above, can readily incorporate a color wheel (e.g., 116, FIG. 10). This is due to the compactness of the light output of the FIG. 9 arrangement that allows use of a small color wheel.

Figure 11:
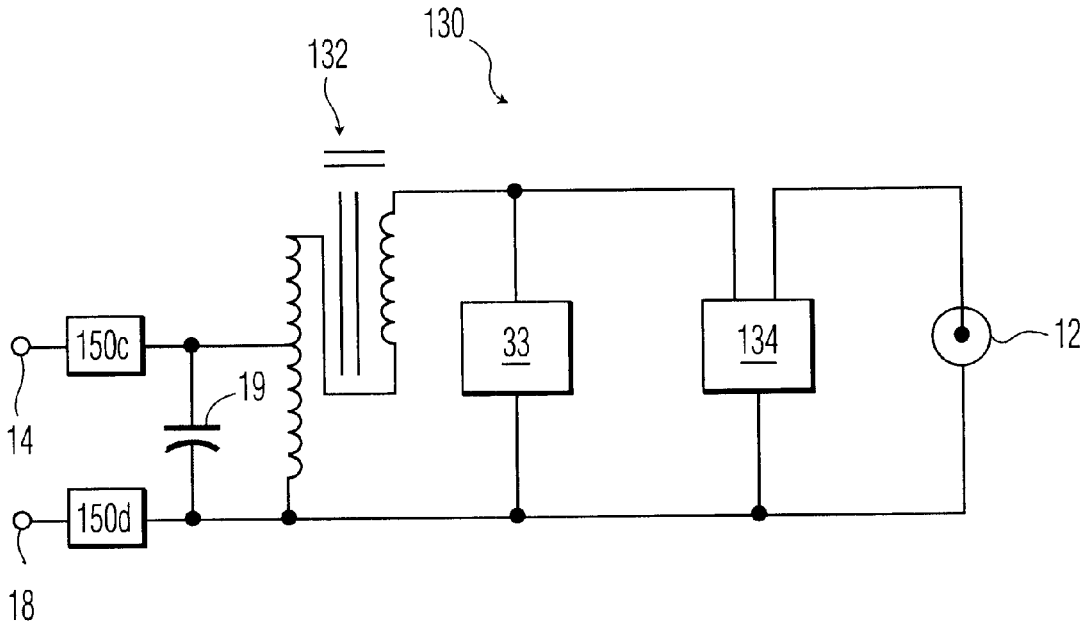
FIG. 11 is a schematic diagram, partly in block, of a ballast circuit for a gas discharge lamp in accordance with a further embodiment of the invention.

FIG. 11 shows a further ballast circuit 130 that may incorporate the present invention. As with ballast circuit 10 of FIG. 1, ballast circuit 130 may receive power from power-supply mains (not shown) between a hot node 14 and a common node 18. Boxes 150*c* and 150*d* represent optional fuse regions of lead portions of nodes 14 and 18, described below. A magnetic ballast, such as a that described above for ballast 20 of FIG. 1, provides a voltage for operating a remote igniter 134, which differs from igniter 26 (FIG. 1) by including its own pulse transformer (not shown). As such, igniter 134 does not use a portion of ballast 132 for creating high voltage spikes in the way that igniter 26 (FIG. 1) uses a portion of ballast 20 for this purpose. Because such spikes are not impressed across water-sensitive circuit 33 (FIG. 11), such circuit does not need to be designed to withstand such spikes as is the case for the FIG. 1 circuit. This further allows ballast 132 to be placed outside the enclosure (e.g., 124, FIG. 12) in which lamp 12 and water-sensitive circuit 33 are placed. Igniter 134 may be a VENTURE Lighting model PPXE100255 igniter.

Other ballasts using inductive, capacitive or resistive circuits to limit ballast current can be used. As an alternative to the magnetic ballasts shown, electronic ballasts can be used with the invention. An example of an electronic ballast incorporates a current-interrupt system (CIS) circuit, which limits ballast current by switching off the current when it reaches a predetermined level.

Fuse Region

The foregoing water-sensitive circuit acts almost instantly. The following figures illustrate another circuit, in the form of a fuse region (e.g., 160 in FIG. 12), for limiting undesirably high voltages. The fuse region acts more slowly than the foregoing water-sensitive circuit, and may be used alone or in combination with the water-sensitive circuit.

Figure 12:
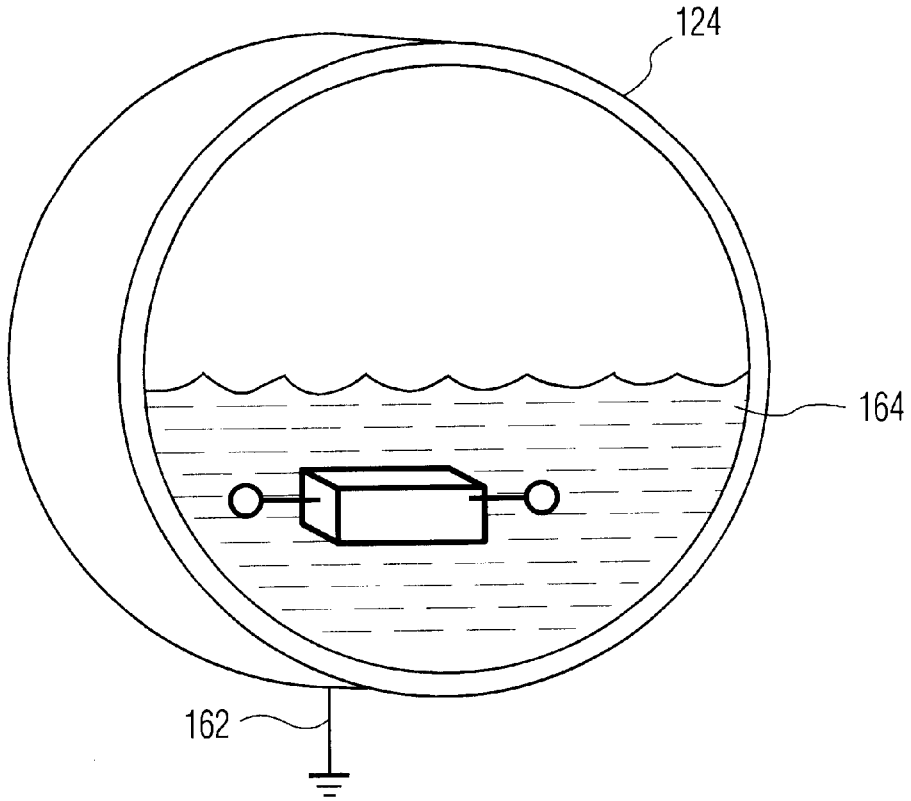
FIG. 12 is a simplified, perspective view, partly in block, of an optional arrangement for limiting voltages associated with a submersible lamp.

FIG. 12 illustrates operation or a fuse region 160 representing one of fuse regions 150*a*–150*d* (FIGS. 1 and 11). Preferred forms of the fuse region are described below. These fuse regions are located in hot node 14 and common node 18 of the ballasted circuits of FIG. 1 or 12. (Alternatively, fuse region 160 may be used in one or both of the hot and common nodes of non-ballasted power-supply circuits for incandescent or other lamps or electrical devices.)

Fuse region 160 (FIG. 12) corrosively reacts and withers away in the presence of water 164 that has leaked into container 124. This process is accelerated when an electric potential difference exists between region 160 and, for instance, container 124 and leaked water 164. In such case, container 124 is electrically conductive and typically at earth ground 162.

Figure 13:
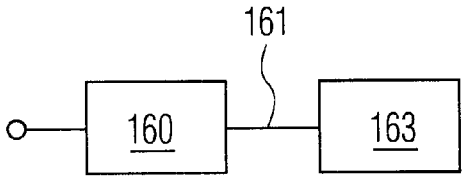
FIG. 13 is a schematic diagram, partially in block form, showing fuse region in a power lead that supplies an electrical load.

FIG. 13 shows fuse region 160 in a power lead 161 supplying an electrical load 163, such as a lamp ballast, a non-ballasted lamp or a color wheel. When the fuse region interrupts current, as described below, power to the load is terminated so that it does not cause undesirably high voltages.

Figure 14:
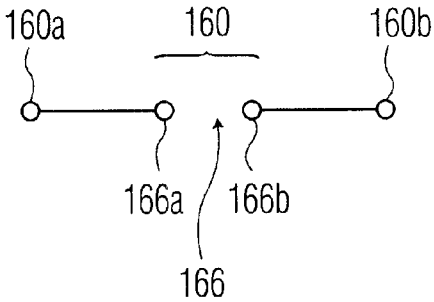
FIG. 14 is a schematic diagram of a fuse region that has undergone a corrosive reaction in accordance with an aspect of the present invention.

As shown in FIG. 14, withered-away fuse region 160 may be so large as to constitute an interruption 166 between node portions 160*a* and 160*b*, whereby fuse regions 166*a* and 166*b* are physically separated from each other. Withering away of the fuse region removes power from a load (e.g., 163, FIG. 13) so that the load does not cause high voltages.

For non-ballasted lamps, where node portion 160*a* (FIG. 14), for instance, is connected to receive a high potential, the exposed surface area of conductor 166*a* at such high potential is limited to the vicinity of fuse region 166*a*. Or, if node portion 160*b* is connected to receive a high potential, the high potential is limited to the vicinity of fuse region 166*b*. This increases safety to nearby persons.

Figure 15:
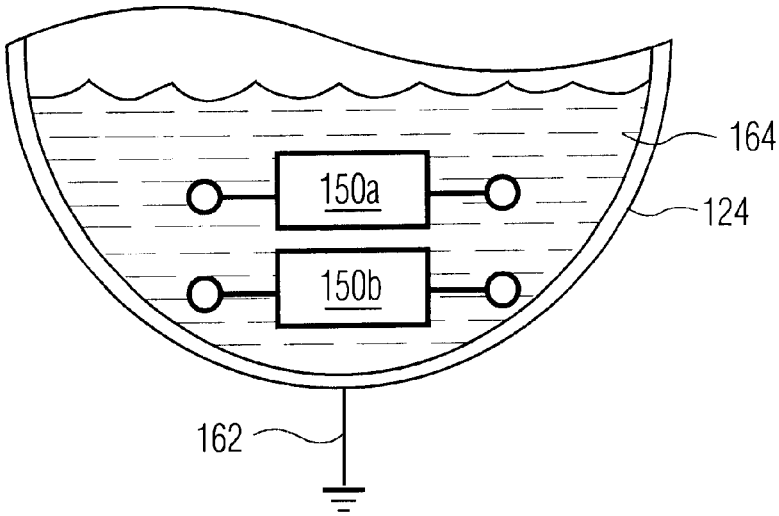
FIG. 15 is a simplified view, partly in block, of a variation of FIG. 12.

FIG. 15 shows other sources of electric potential difference that may accelerate corrosive reaction. In that figure, an effective potential difference may exist between fuse regions 150*a* and 150*b*, for instance. Alternatively, if common node 150*b* has been mistakenly wired to high potential, instead of hot node 150*a*, an effective potential difference may exist between fuse region 150*b* in the common node and container 124. Other pairs of conductors between which an effective potential difference may exist will be apparent to those of ordinary skill in the art.

Figure 16:
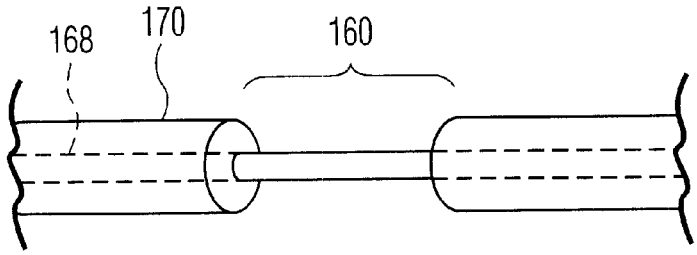
FIG. 16 is a perspective view of a fuse region of a power lead.
Figure 17:
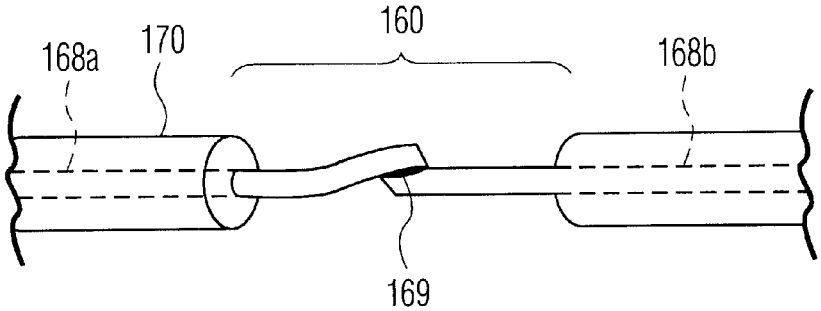
FIG. 17 is similar to FIG. 15 and shows another form of fuse region.

As shown in FIG. 16, fuse region 160 may simply be an area of a lead 168 having insulation 170 removed. Or, as shown in FIG. 17, fuse region 160 could include a weld junction 169 between dissimilar metals 168*a* and 168*b*. As such, the Fermi electric potential between dissimilar metals hastens corrosion at the weld junction.

Figure 18:
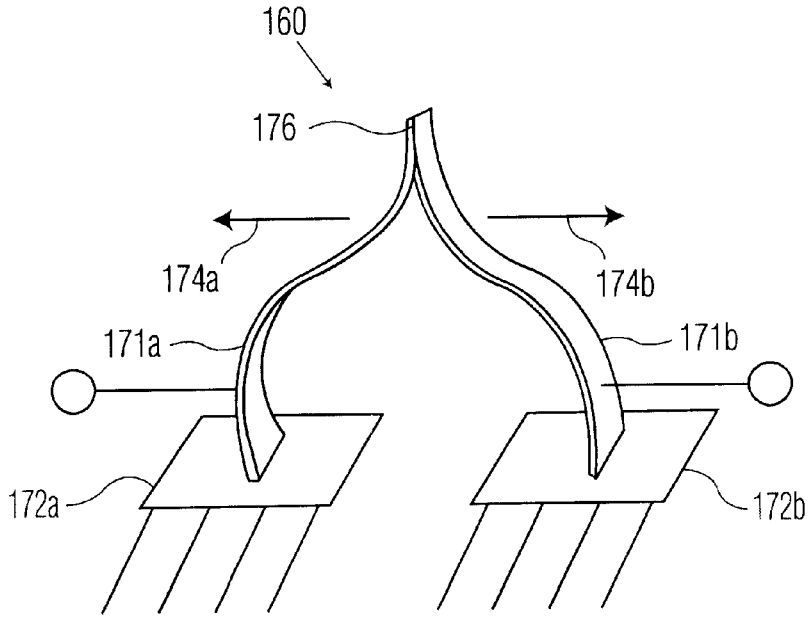
FIG. 18 is a perspective view, partially diagrammatic, of another fuse region of a power lead.

FIG. 18 shows a fuse region 160 comprised of two strips 171*a* and 171*b*, preferably of resilient metal, having their distal ends preferably mounted on respective support portions 172*a* and 172*b*. The proximate ends of the strips are welded together at junction 176, although they are preferably biased apart resiliently in the respective directions of arrows 174*a* and 174*b*. Typically, fuse region 160 preferentially corrodes at the weld junction. The resilient bias beneficially hastens the separation of strips 171*a* and 171*b*. Beneficially, these strips comprise dissimilar metals so as to hasten corrosion.

Figure 19:
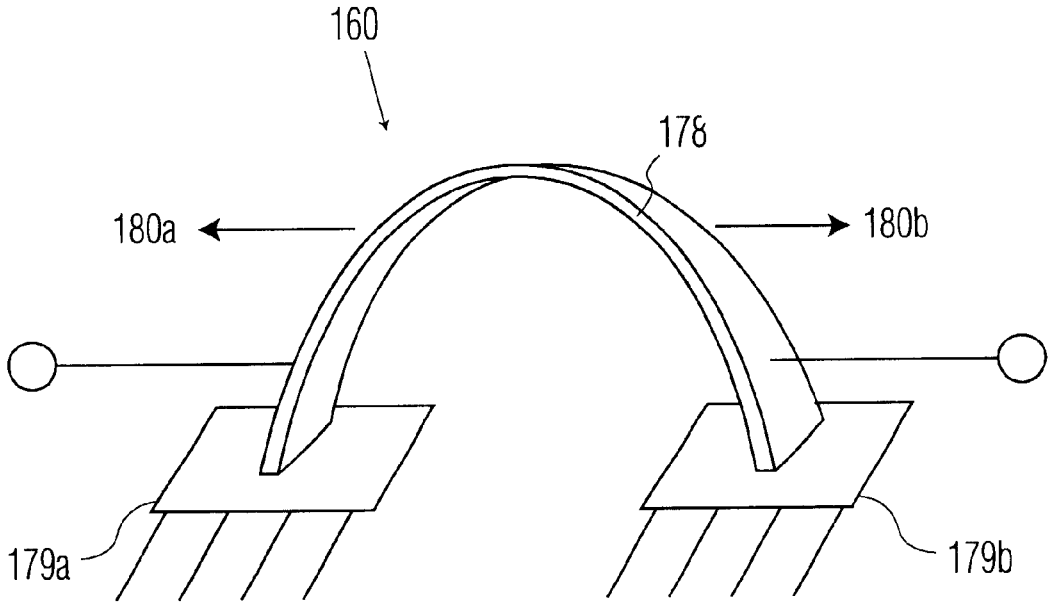
FIG. 19 is similar to FIG. 17 and shows another fuse region.
Figure 20:
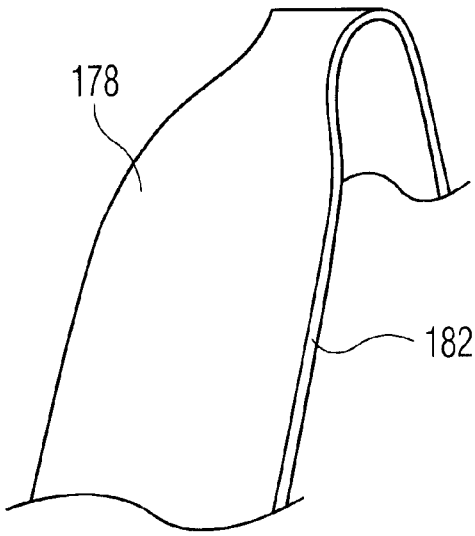
FIG. 20 is a detail side perspective view of a variation of the fuse region of FIG. 18.

FIG. 19 shows a fuse region comprising a single strip 178 of conductor with its distal ends preferably mounted on support portions 179*a* and 179*b*. Preferably, the left- and right-shown portions of strip 178 are resiliently biased apart in the respective directions of arrows 180*a* and 180*b*. FIG. 20 shows a preferred variation in which strip 178 is "necked" down in region 182 to facilitate corrosion.

Preferably, first and second sides of a fuse region (not shown) that adjoin each other at an intermediate region are resiliently biased apart from each other at least in the presence of leaked water. Thus, frangible material such as disclosed in U.S. Pat. No. 4,888,455 issued Dec. 19, 1989 could dissolve in the presence of water and, once dissolved, enable the desired resilient bias. Such an embodiment will be routine to those of ordinary skill in the art based on the present specification.

Preferably, a fuse region can be physically incorporated into a cage for housing a water-sensitive device. Thus, referring back to FIG. 6, an insulated power lead having a first end 184*a* and an second end 184*b* could pass into the cage through guides 185 mounted on frame member 74. Preferably, ends 184*a* and 184*b* are potted to guides 185. Fuse portion 160, of bared wire, for instance, then extends within the cage, and preferably is confined within grooves 186*a* and 186*b* of frame members 66 and 64, respectively. As used herein, "wire" includes solid or multi-strand wire. Another power lead (not shown) could extend through further guides 187 in a similar manner as for the just-described power lead. In actual use, the left-shown frame member 74 would then preferably be positioned horizontally, at the bottom of the cage.

Persons of ordinary skill in the art will find it routine to select the rapidity of corrosion of the region by selecting the size, material and placement of fuse region 160, and the surface areas of that region and one or more other conductors at a different potential. For instance, increasing the surface area of conductive container 124 at earth ground, for instance, will increase rapidity of corrosion.

The water-sensitive circuit and the fuse region beneficially cooperate together. While the water-sensitive circuit acts quickly to limit undesirably high voltages in the presence of leaked water, such water creates a corrosive environment for it and other ballast components. So, after some lapse of time, corrosion could impair the effectiveness of the water-sensitive circuit unless it and other ballast components are made especially resistant to corrosion. Doing so could add significant cost to the ballast. Fortunately, although the fuse region acts more slowly than the water-sensitive circuit, it provides a complementary and economical way to limit undesirably high voltages before corrosion can impair the effectiveness of the water-sensitive circuit.

Similarly, the fuse region can cooperate with other electrical devices so they can be made more economically than would be required if made very corrosion resistant. Thus, other devices, such as a non-ballasted lamp or color wheel, can be made less corrosion resistant while still being protected from undesirably high voltages by a fuse region.

While the invention has been described with respect to specific embodiments by way of illustration, many modifications and changes will occur to those of ordinary skill in the art. For instance, a fluorescent lamp or other cathode-heated type of lamp could be used rather than the non-cathode heated types of lamps described above. It will be a routine matter to a person of ordinary skill in the art to provide circuitry for heating the cathodes. It is, therefore, to be understood that the appended claims are intended to cover all such modifications and changes as fall within the true scope and spirit of the invention.

What is claimed is:

1. A light fixture with a submersible enclosure for a gas discharge lamp, comprising:

a) a ballast for supplying power to a high intensity discharge lamp;

b) a submersible enclosure for sealing the lamp from water in normal operation; and c) a water-sensitive circuit having a conductance that increases in response to water that leaks into the enclosure for conducting current from the ballast and limiting the ballast voltage.

2. A light fixture with a submersible enclosure for a gas discharge lamp, comprising:

a) a ballast for supplying power to a high intensity discharge lamp;

b) a submersible enclosure for sealing the lamp from water in normal operation; and c) a water-sensitive circuit connected between first and second nodes and having a conductance that increases in response to water that leaks into the enclosure for conducting current from the ballast and limiting its voltage; the water-sensitive circuit comprising:

i) at least first and second electrodes respectively connected between the first and second nodes and spaced apart from each other to create a conductive path in a volume between the electrodes; the volume normally having a conductivity below $1/130{,}000$ mho-cm;

ii) the volume being open to receive water that water leaks into the enclosure, so as to increase the conductance of the water-sensitive circuit.

3. The fixture of claim 2, wherein the conductivity of the volume reaches at least about $1/30{,}000$ mho-cm when water that leaks into the enclosure fills the volume.

4. The fixture of claim 2, wherein the conductance of the water-sensitive circuit is in a range from about $1/200$ mhos to about 1 mho when the volume is filled with water.

5. The fixture of claim 2, wherein:

a) the first and second electrodes respectively comprise first and second leaves; and b) the water-sensitive circuit further comprises third and fourth electrodes respectively comprising third and fourth leaves and respectively connected to the first and second nodes, a volume between which is open to receive water that leaks into the enclosure so as to increase the conductance of the water-sensitive circuit.

6. The fixture of claim 5, wherein:

a) the leaves are arranged along an axis generally orthogonal to the leaves in the order of first leave, second leave, third leave and fourth leave; and b) a volume between the second and third leaves, in addition to the first-mentioned and second-mentioned volumes, being open to receive water that leaks into the enclosure so as to increase the conductance of the water-sensitive circuit.

7. The fixture of claim 2, wherein:

a) the first electrode comprises a first set of leaves; and b) the second electrode comprises a second set of leaves;

c) the first and second sets of leaves being arranged in interdigitated fashion with respect to each other.

8. The fixture of claim 7, wherein the first set of leaves is between 1 and 5 in number, and the second set of leaves is between 2 and 6 in number.

9. The fixture of claim 2, comprising an electrically nonconductive cage surrounding the first and second electrodes and being provided with sufficient openings to allow ingress of water above a predetermined level that leaks into the enclosure.

10. The fixture of claim 2, wherein:

a) the enclosure contains a power lead for supplying a.c. power to an electrical load; and b) the power lead includes a fuse region that corrosively reacts in the presence of leaked water in the container, so as to sufficiently wither away the fuse region and terminate power to the lamp.

11. The fixture of claim 10, wherein the electrical load comprises the ballast.

12. The fixture of claim 2, comprising an electrically nonconductive cage surrounding the first and second electrodes and containing inwardly facing slots for receiving portions of the first and second electrodes for maintaining a desired spacing between the first and second electrodes.

13. The fixture of claim 2, wherein the first and second electrodes are oriented generally vertically.

14. The fixture of claim 2, wherein the first and second electrodes are positioned at the bottom of the enclosure.

15. The fixture of claim 2, wherein:

a) the ballast includes an igniter, located in the enclosure, for providing high voltage starting pulse for the lamp; and b) the first and second electrodes are positioned below the ignitor.

16. The fixture of claim 1 or 2, further comprising a color filter for coloring the light from the lamp.

17. A light fixture with a submersible enclosure for a gas discharge lamp, comprising:

a) a ballast for supplying power to a gas discharge lamp;

b) a submersible enclosure for sealing the lamp from water in normal operation; and c) a water-sensitive circuit having a conductance that increases in response to water that leaks into the enclosure for conducting current from the ballast and limiting its voltage;

d) the lamp including a generally tubular, hollow coupling device with an interior light-reflective surface for receiving light from the lamp at an inlet and transmitting It as a generally diverging light beam through an outlet; the coupling device being shaped in accordance with non-imaging optics and increasing in cross sectional area from inlet to outlet so as to reduce the angle of light reflected from the surface as it passes through the device.

18. The fixture of claim 16, wherein the lamp is a high intensity discharge lamp.

19. The fixture of claim 16, comprising:

a) a plurality of color filters; and b) a motor adapted to move a color filter into position to color light from the lamp.

20. The fixture of claim 1, 2 or 17, wherein the water-sensitive circuit normally conducts substantially less current than the lamp.

21. The fixture of claim 1, 2 or 17, wherein the current level of the water-sensitive circuit is normally less that about 1 percent of the level of lamp current.

22. The fixture of claim 1, 2 or 17, wherein the water-sensitive circuit is so designed that, when its conductance increases, it sufficiently loads the ballast to prevent its voltage from reaching an undesirably high level.

23. The fixture of claim 1, 2 or 17, further comprising:

a) an ignitor, supplied with driving voltage from the ballast, for supplying high voltage starting pulses to the lamp when the driving voltage exceeds a threshold level;

b) the increase in conductance of the water-sensitive circuit being sufficient to load the ballast so as to maintain the driving of the ignitor below its threshold level.

24. The fixture of claim 1, 2 or 17, wherein:

a) the water-sensitive circuit comprises a water-responsive device, serially connected to the ballast, whose conductance during normal operation of the lamp is too low to prevent the ballast voltage from reaching normal starting levels for the lamp; and b) the water-responsive device becoming sufficiently conductive when water leaking into the enclosure reaches a predetermined level so as to conduct sufficient ballast current to prevent the ballast voltage from reaching an undesirably high level.

25. The fixture of claim 1, 2 or 17, wherein the lamp is a high intensity discharge lamp.

26. The fixture of claim 1, 2 or 17, wherein the ballast is located in the enclosure.

27. The fixture of claim 1, 2 or 17, wherein:

a) the enclosure contains a power lead for supplying a.c. power to an electrical load; and b) the power lead includes a fuse region that corrosively reacts in the presence of leaked water in the container, so as to sufficiently wither away the fuse region and terminate power to the load.

28. The fixture of claim 27, wherein the electrical load is the ballast of the lamp.

29. The fixture of claim 27, wherein the fuse region is located beneath the level of the water-sensitive device so as to start becoming corroded in the presence of leaked water before the conductance of the water-sensitive circuit starts to increase.

30. A light fixture with a submersible enclosure for an electric lamp, comprising:

a) a submersible enclosure for sealing the lamp from water in normal operation;

b) the enclosure containing a power lead for supplying power to the lamp; and c) the power lead including a fuse region that corrosively reacts in the presence of leaked water in the enclosure, so as to sufficiently wither away the fuse region and terminate power to the lamp.

31. The fixture of claim 27, further comprising at least one other conductor:

a) that is in contact with the leaked water; and b) that is at a potential different from the power lead.

32. The fixture of claim 27, wherein the fuse region comprises first and second sides adjoining each other at a necked-down region.

33. The fixture of claim 27, wherein the power lead comprises:

a) first and second insulated wire portions between which the fuse region is interconnected;

b) the fuse region comprising first and second sides each comprising a wire exposed so that leaked water can come into contact with it; and c) the respective wire of the first side comprising an extension of the wire of the first insulated wire portion with the same cross section, and the respective wire of the second side comprising an extension of the wire of the second insulated wire portion with the same cross section.

34. The fixture of claim 33, wherein the respective wires of the first and second sides comprise a single, continuous wire of the same metal.

35. The fixture of claim 33, wherein the respective wires of the first and second sides comprise separate wires that are joined together.

36. The fixture of claim 35, wherein the separate wires are joined together by welding.

37. The fixture of claim 35, wherein the adjoining portions of the first and second sides comprise dissimilar metals.

38. The fixture of claim 27, wherein:

a) the fuse region has first and second sides that adjoin each other at an intermediate location;

b) the first and second sides are arranged to be resiliently biased apart from each other at least in the presence of leaked water; and c) that portion of the fuse region in the vicinity of the intermediate location is arranged to corrode in the presence of leaked water and to break apart under tension from the biased first and second ends.

39. The fixture of claim 38, wherein the adjoining portions of the first and second sides comprise dissimilar metals.

40. The fixture of claim 38, wherein the fuse region in the vicinity of the intermediate location is necked down relative to respective, adjacent portions of the fuse portion.

41. The fixture of claim 30, further comprising at least one other conductor a) that is in contact with the leaked water; and b) that is at a potential different from the power lead.

42. The fixture of claim 30, wherein the fuse region comprises first and second sides adjoining each other at a necked-down region.

43. The fixture of claim 30, wherein the power lead comprises:

a) first and second insulated wire portions between which the fuse region is interconnected;

b) the fuse region comprising first and second sides each comprising a wire exposed so that leaked water can come into contact with it; and c) the respective wire of the first side comprising an extension of the wire of the first insulated wire portion with the same cross section, and the respective wire of the second side comprising an extension of the wire of the second insulated wire portion with the same cross section.

44. The fixture of claim 30, wherein:

a) the fuse region has first and second sides that adjoin each other at an intermediate location;

b) the first and second sides are arranged to be resiliently biased apart from each other at least in the presence of leaked water; and c) that portion of the fuse region in the vicinity of the intermediate location is arranged to corrode in the presence of leaked water and to break apart under tension from the biased first and second ends.

* * * * *